US007223184B2

(12) United States Patent
Suwito

(10) Patent No.: US 7,223,184 B2
(45) Date of Patent: May 29, 2007

(54) GOLF TEE SETTING DEVICE AND METHOD

(75) Inventor: Wantjinarjo Suwito, Longmont, CO (US)

(73) Assignee: Aviar Technology, Longmont, CO (US)

( * ) Notice: Subject to any disclaimer, the term of this patent is extended or adjusted under 35 U.S.C. 154(b) by 0 days.

(21) Appl. No.: 10/851,265

(22) Filed: May 21, 2004

(65) Prior Publication Data

US 2005/0261088 A1 Nov. 24, 2005

(51) Int. Cl.
*A63B 57/00* (2006.01)

(52) U.S. Cl. ..... 473/386

(58) Field of Classification Search ..... 473/386–403; D21/718

See application file for complete search history.

(56) References Cited

U.S. PATENT DOCUMENTS

| | | | | | |
|---|---|---|---|---|---|
| 3,540,727 | A | * | 11/1970 | Solomon, Jr. | 473/386 |
| 3,658,331 | A | * | 4/1972 | Driscoll | 473/386 |
| 3,671,036 | A | * | 6/1972 | Rubino | 473/386 |
| D249,657 | S | | 9/1978 | Griffiths | D10/69 |
| 4,142,719 | A | | 3/1979 | Blood | 273/33 |
| 4,277,892 | A | | 7/1981 | Rushforth | 30/368 |
| 4,660,837 | A | | 4/1987 | Bressie | 273/32.5 |
| 4,896,883 | A | | 1/1990 | Wagenknecht | 273/32.5 |
| 4,982,510 | A | * | 1/1991 | Musillo | 33/833 |
| 4,989,868 | A | * | 2/1991 | Manko | 473/386 |
| 5,037,150 | A | | 8/1991 | Vecchi | 294/19.2 |
| 5,080,357 | A | | 1/1992 | Wolf | 273/32.5 |
| 5,165,744 | A | | 11/1992 | Vogrin | 294/19.2 |
| 5,171,010 | A | | 12/1992 | Lanoue | 273/32.5 |
| D344,779 | S | | 3/1994 | Axne | D21/234 |
| 5,310,177 | A | * | 5/1994 | Conrad et al. | 473/386 |
| 5,370,388 | A | | 12/1994 | Wehner | 273/32.5 |
| 5,413,330 | A | | 5/1995 | Disco et al. | 273/33 |
| D362,480 | S | | 9/1995 | Reaves | D21/208 |
| 5,624,333 | A | | 4/1997 | Dayton | 473/386 |
| 5,632,696 | A | | 5/1997 | Nichols et al. | 473/386 |
| 5,634,862 | A | | 6/1997 | Gamache | 473/386 |
| 5,643,113 | A | | 7/1997 | Rodgers | 473/386 |
| 5,672,122 | A | | 9/1997 | Strong | 473/398 |
| 5,679,081 | A | | 10/1997 | Santilli | 473/391 |
| 5,718,646 | A | | 2/1998 | Brewer | 473/386 |
| 5,735,758 | A | | 4/1998 | Miketinac | 473/386 |
| 5,772,533 | A | | 6/1998 | Dahlmann | 473/386 |
| 5,839,972 | A | | 11/1998 | Swanson | 473/286 |
| 5,857,927 | A | | 1/1999 | Driscoll et al. | 473/386 |
| 5,885,174 | A | | 3/1999 | Barnes | 473/386 |
| 5,913,737 | A | | 6/1999 | Park | 473/386 |
| 6,004,227 | A | | 12/1999 | Petersen | 473/386 |
| 6,004,228 | A | | 12/1999 | Adam | 473/403 |
| 6,053,821 | A | | 4/2000 | Palmer | 473/386 |
| 6,176,794 | B1 | | 1/2001 | Kim | 473/402 |

(Continued)

OTHER PUBLICATIONS

Photogaphs of T-Set device: www.dwguailgolf.com.

(Continued)

*Primary Examiner*—Steven Wong
(74) *Attorney, Agent, or Firm*—Sheridan Ross P.C.

(57) ABSTRACT

A device is provided for setting a golf tee in the ground at a desired height and angle. In one embodiment, height adjustment of the tee is provided by a threaded screw member. In other embodiments, a plurality of longitudinally aligned recesses are formed within a longitudinal cavity to provide height adjustment. A bubble level may be incorporated on the device to align the golf tee at either a vertical position, or a desired angular position.

1 Claim, 4 Drawing Sheets

U.S. PATENT DOCUMENTS

| | | | | |
|---|---|---|---|---|
| 6,203,452 | B1 | 3/2001 | Kelman et al. | 473/386 |
| 6,254,497 | B1 | 7/2001 | Brant et al. | 473/386 |
| 6,273,833 | B1 | 8/2001 | Murphy | 473/386 |
| 6,287,219 | B1 * | 9/2001 | Addington | 473/386 |
| 6,338,685 | B1 | 1/2002 | Posluszny | 473/386 |
| 6,428,429 | B1 | 8/2002 | Lee | 473/386 |

OTHER PUBLICATIONS

Illustration of the STAND device; www.macbirdie.com/productdetail.asp/.

Photograph of Flex Tee device: www.flextee.net.

Photograph of Tee Wizard device: www.wisconsincamping.com/teewizard/.

Photograph of Stepstixx Tees: www.womenonthegreen.com/holes/accessories.htm.

Illustration of the Perferct Tee device: www.perfecttee.com.

Illustration of the Brush Tee device: www.brusht.com.

Illustration of the Anti-slice Tee device: www.golfaids.co.uk/acatalog/antislicetees.html.

* cited by examiner

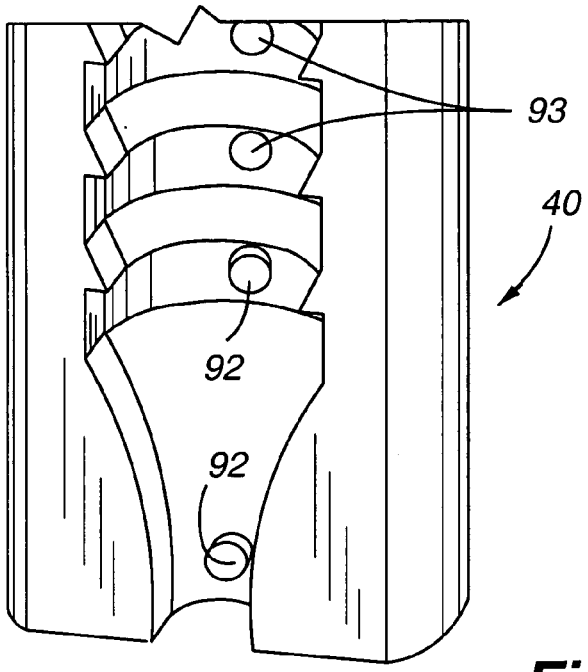
Fig. 10
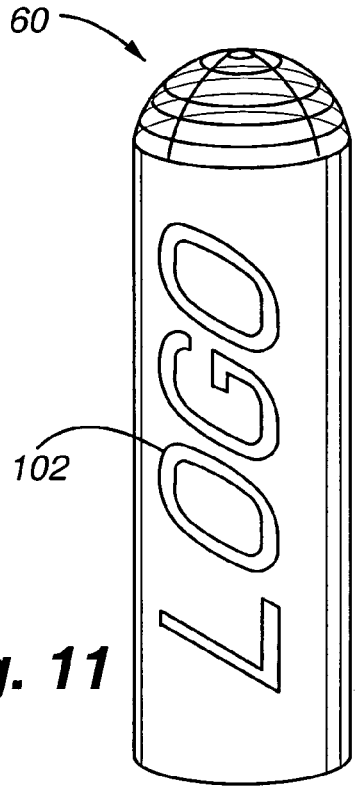
Fig. 11
Fig. 12
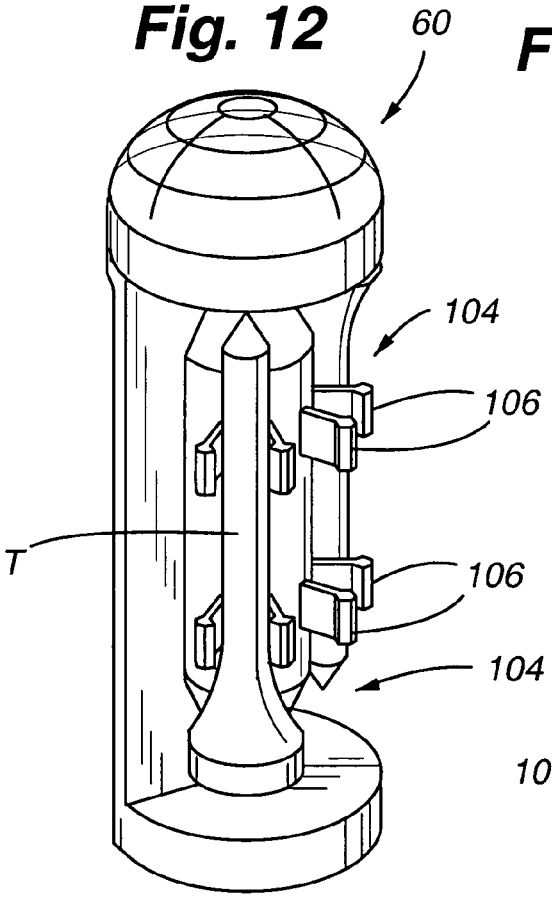
Fig. 13
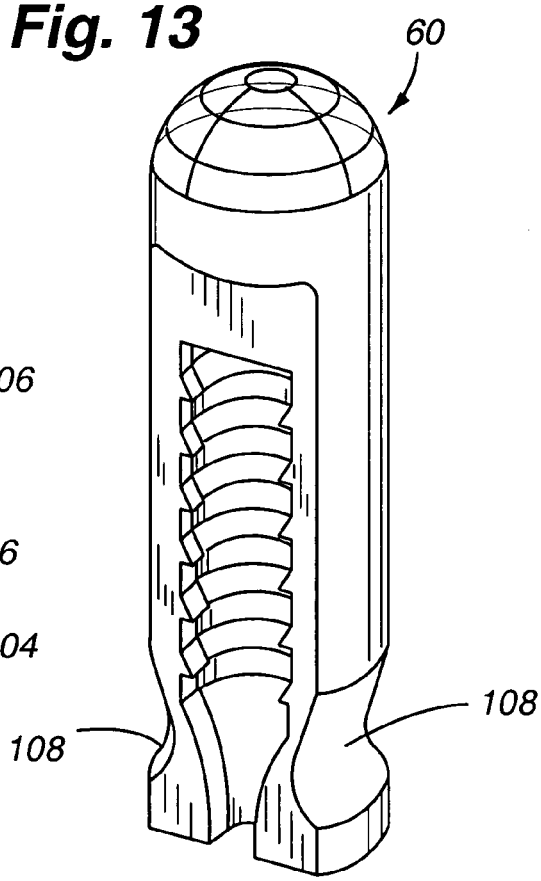

GOLF TEE SETTING DEVICE AND METHOD

FIELD OF THE INVENTION

The present invention relates to devices used to control placement of an object into the ground, and more particularly, to a golf tee setting device and a method wherein the device is adjustable for enabling a user to precisely align the height of a golf tee above the ground, and the angle at which the golf tee extends from the ground.

BACKGROUND OF THE INVENTION

In the game of golf, a golfer is allowed to hit the golf ball from the tee box by placing the ball on a golf tee to raise the level or height at which the ball rests above the ground. Particularly for use of drivers or other clubs of similar configurations, it is necessary to raise the height of the ball to some level thereby ensuring the club face strikes the ball at the correct height and angle.

A performance goal for professional as well as recreational golfers is to develop skills so that the game of golf becomes a more routine and repeatable sequence of actions thereby helping to eliminate the great number of variables that can produce an undesirable golf score. Highly skilled golfers such as professionals have the opportunity to play golf quite frequently, and because of this frequency, these golfers develop a certain "feel" for every aspect of the game to include the manner in which a golf ball is properly teed. However, recreational golfers do not get the opportunity to play as frequently, and inherently, will not have either the skill, patience, or discipline to correctly tee the golf ball each time. Ultimately, proper setting of the tee is important because it affects a golf ball's launch angle, launch direction, and the type and amount of spin imparted on the ball. Accordingly, improperly setting the golf tee will undermine a golfer's opportunity to shoot a better score.

A number of prior art devices exist to assist a golfer in setting a golf tee at the proper height. One example of such a device is disclosed in the U.S. Pat. No. 5,370,388. This reference discloses a device having a threaded arrangement that allows a user to incrementally select a height at which a golf tee extends above the ground.

U.S. Pat. No. 5,080,357 is another example of a device used to set a golf tee. This device includes a pair of articulated jaw assemblies located at a lower end portion of an elongated tubular shaft, and a handle jaw operating lever located at an upper end of the shaft. Manual squeezing of the lever moves an actuation rod within the shaft causing opposed lengths associated with the rod to move each jaw assembly outwardly. The jaw assemblies coact to hold a golf ball and tee, and are releaseable therefrom after the tee has been inserted into the ground.

Yet another example of a device used for adjustably setting a golf tee includes the invention disclosed in U.S. Pat. No. 5,643,113. This reference discloses a clamp for engaging the shaft of the golf tee, and a positioning screw engages a head of the golf tee such that a predetermined length of the tee shaft projects beyond the clamp for insertion into the ground.

Although there are a number of prior inventions that exist, many of them suffer from various disadvantages to include being structurally complex and difficult to use. Additionally, the prior art suffers in that the references fail to provide both angular alignment and height adjustment of the tee with respect to the ground. Additionally, the prior art suffers in that many of the devices are large and bulky, and are not easily stored or carried by a golfer.

SUMMARY OF THE INVENTION

It is one object of the present invention to provide a golf tee setting device that is structurally simple, yet provides a golfer with an effective solution for setting a golf tee at a precise height and angle with respect to the ground.

It is yet another object of the invention to provide a golf tee setting device that is easily and precisely adjustable allowing a golfer to choose the desired height and angle of the tee.

In accordance with the method of the present invention, it is also an object of the present invention to provide a quick and repeatable method of setting a golf tee, along with easy disengagement of the device from the golf tee after it has been set.

It is yet another object of the present invention to provide a device that is adapted for use with the most common form of golf tees, namely, wooden tees used by both professionals and recreational golfers.

In accordance with a first preferred embodiment of the present invention, the device of the invention may be constructed from a cylindrical or approximately cylindrical piece of material having a threaded adjustment screw manipulated by the user to set the particular height of the golf tee. The body has a longitudinal cavity formed therethrough for receiving the adjustment screw. A slot is formed in the body by removing a section thereof thus exposing the longitudinal cavity enabling a user to view the tee when engaged with the device. A visual scale may be incorporated on the body of the device enabling the golfer to quickly reference the desired height to set the tee. A bubble level may be attached to an upper portion of the body thereby allowing a user to adjust and set the angular orientation of the tee with respect to the ground.

In another embodiment of the present invention, in lieu of using a threaded adjustment screw to adjust the setting of the tee, a plurality of stepped openings may be formed in the chamber, the openings being aligned longitudinally with one another along the length of the body. Thus, several incremental tee heights are provided. In the second embodiment, a bubble level may also be incorporated to provide a user with the capability to adjust the angular orientation of the tee. It may also be desirable to offset the bubble level so that the golfer can engage the upper portion of the body when setting the golf tee, thus, the bubble level remains visible for angular adjustment of the tee as necessary.

In lieu of a bubble level, it may be desirable to incorporate other accessories on the device such as ornaments, or a key chain holder.

Yet another feature that may be incorporated with the present invention is a plurality of arcuate shaped grooves formed on a bottom portion of the device, these grooves being particularly adapted for creating low golf tee settings.

In yet another feature of the present invention, multiple cavities may be provided on the body to provide a user with additional tee settings.

It is also contemplated within the present invention that the depth of the cavity formed in the body can be varied to best suit the desired manner in which to engage and disengage the golf tee.

In yet another feature of the present invention, one or more fine adjustment elements may be provided in the form of small projections in the cavity of the body. These projections provide a pre-set angular orientation of the tee with respect to the ground.

In yet another feature of the present invention, the back or rear side of the body of the device may be especially adapted to receive an advertising logo, or an additional cavity may be formed in the rear side of the body for storing one or more golf tees.

In yet another feature of the present invention, the lower portion of the device may have an external annular groove thereby providing a better gripping surface for the user to set a tee.

Because of the relatively small size and cylindrical shape of the device, the device fits well in a golfer's hand and is easily carried by the golfer.

Other features and advantages of the present invention will become apparent from a review of the drawings, taken in conjunction with the detailed description.

BRIEF DESCRIPTION OF THE DRAWINGS

FIG. 10 is an enlarged fragmentary perspective view of the device wherein angular adjustment of a tee may be modified by use of one or more protrusions within the cavity;

FIG. 11 is a perspective view of a rear or backside of the body of the device especially adapted for receiving an advertisement;

FIG. 12 is a perspective view of the backside of the device modified to include an additional cavity and brackets for holding one or more golf tees; and FIG. 13 illustrates another modification of the present invention wherein an external groove is formed on a lower portion of the device thereby providing a more ergonomic gripping surface for emplacement of the golf tee in the ground.

DETAILED DESCRIPTION

Figure 1:
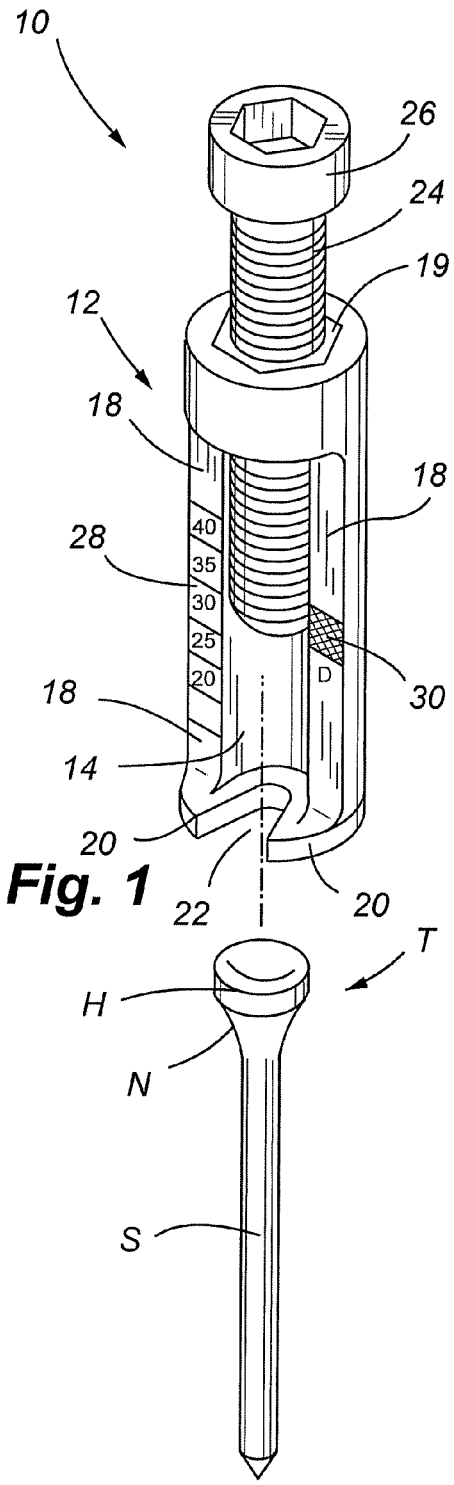
FIG. 1 is a perspective view of the device of the present invention.
Figure 2:
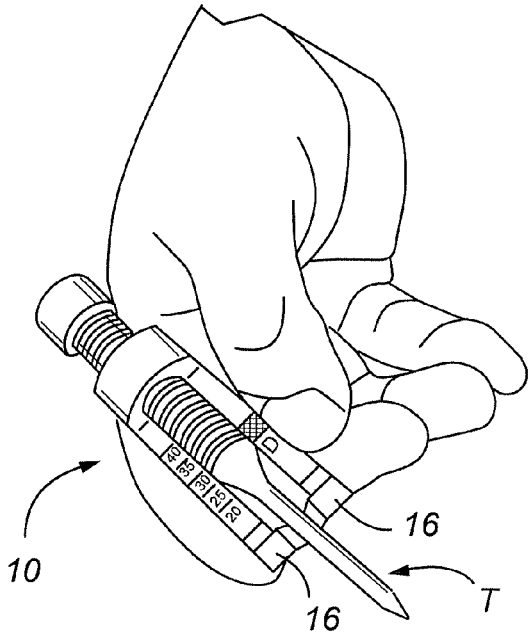
FIG. 2 is another perspective view showing a golf tee engaged with the device.

Referring to FIGS. 1 and 2, a first preferred embodiment of the invention is shown. The device 10 is defined by a body 12 having a longitudinal channel or cavity formed therethrough defined by interior surface 14. One side or surface of the body 12 is removed thereby exposing the cavity. Faces 18 define the areas where the body 12 has been removed to expose the cavity, the removed portion also referred to as a slot.

The body 12 is shown as being elongated, and may be made in a cylindrical shape. An upper portion of the body 12 includes a threaded opening. The threaded opening receives an adjustment screw 24. The threaded opening may simply include threads formed on the interior surface of the body defining the opening, or a threaded insert 19 can be mounted within a non-threaded opening. The adjustment screw 24 includes a screw head 26 that may be manipulated by the golfer to vary the length at which the screw 24 is positioned within the cavity. The position of the screw 24 determines the height of the tee to be set. A lower portion of the body 12 includes a pair of flanges 20, and a notch 22 formed between the flanges.

Referring to FIG. 2, a standard golf tee T is shown engaged with the device 10. The golf tee T includes a head H, a shaft S, and a neck portion N. The upper surface of the head H contacts the free end of the adjustment screw 24. A user may rotate the adjustment screw to position the tip of the screw along scale 28. Scale 28 may be a distance scale or index indicating the height at which the tee is to be positioned with respect to the ground. Optionally, an additional scale in the form of a club head selection scale or range 30 may be provided on the other face 18 also providing a golfer an indication of where to position the tip of the adjustment screw 24. For example, the cross-hatched lines positioned above the letter D indicates a range corresponding to a desired tee setting for a particular golf club, such as a driver.

In use, a golfer secures a golf tee, inserts it in the cavity, and places the top surface of the golf tee against the end of the screw 24, as shown in FIG. 2. A user then adjusts the adjustment screw 24 to position the tee at the desired height, utilizing either the scale 28 and/or scale 30. The golfer then places one or more fingers over the head of the golf tee to ensure that the golf tee remains engaged within the cavity and against the end of the adjustment screw. The golfer then presses the golf tee into the ground until the lower surface or edge 16 of the device is flush with the ground. The device is then disengaged from the golf tee by simply moving the device laterally away from the golf tee.

Figure 3A:
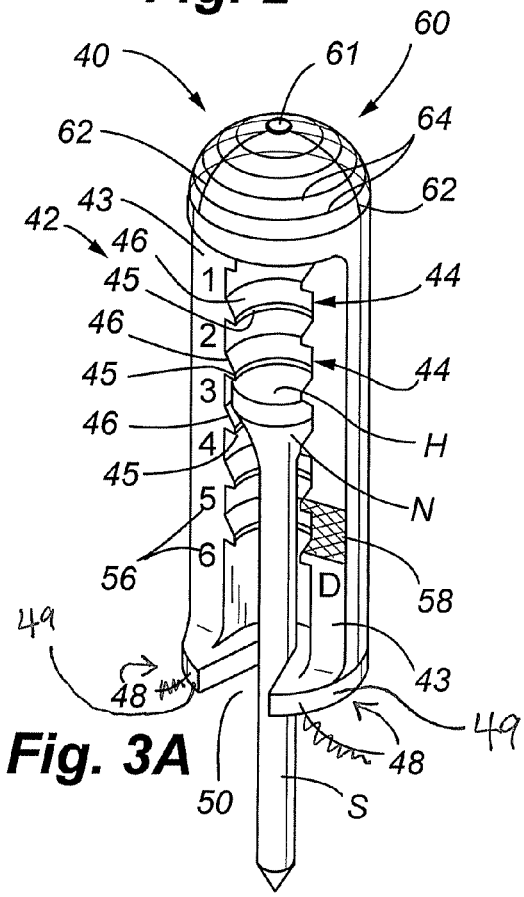
FIG. 3A is a perspective view of a second embodiment of the present invention.

Referring to FIG. 3A, another preferred embodiment of the present invention is shown. In this second embodiment, the device 40 is also characterized as having a cylindrical shaped body 42, and a longitudinal cavity extending therethrough. Within the longitudinal cavity, a plurality of longitudinally aligned recesses 44 are formed, the recesses 44 being sized and spaced from one another to create incremental tee settings. The recesses are shaped to receive the head H of the golf tee, as shown. The recesses are defined by a plurality of ridges 45 extending from the interior surface defining the cavity. The recesses 44 may be further defined as including arcuate sloping portions 46 that abut the neck N of the tee. In FIG. 3A, a total of six settings are provided for height adjustment of the golf tee; however, more or less settings can be provided as desired. The device 40 may further include a setting scale 56 and/or a club level selection scale 58 placed on the respective faces 43 of the body. The device 40 further includes a pair of flanges 48 formed at a lower portion thereof and a notch 50 positioned between the pair of flanges 48. As shown, the body 12 maintains its cylindrical shape at the location of the flanges 48 so that the notch 50 is simply a cut out portion and the flanges do not protrude beyond the cylindrical shape.

As also shown, the flanges 48 have a uniform thickness edge 49 forming a most lower end of the body 12. The edge 49 is a continuation of the body 12 and extends perpendicular to the notch 50.

One additional feature shown with respect to the embodiment in FIG. 3A is a bubble level 60. The bubble level is simply attached to the upper surface of the body 42. The bubble level may include indicia such as an alignment mark 61, cross hairs 62, and angular alignment lines 64.

In use, a golfer secures the tee within the recess 44 corresponding to the desired height at which the golfer desires to set the tee. The golfer holds the golf tee and device 40, and presses the tee into the ground. As the golfer inserts the tee, the golfer may observe the bubble within the bubble level to align the bubble with the indicia.

In some circumstances, it may be desirable to place the tee at a particular angle depending upon the type of club used, and the desired golf shot to be obtained. For example, placing the golf tee at a slight rearward angle with respect to the flight direction of the ball may assist a golfer in creating a back spin when the club face strikes the ball, or placing the golf tee at a slight forward angle with respect to the flight direction may assist a golfer in creating an over spin when the club face strikes the ball. If the golfer desires to set the tee at an angle, the golfer would choose a particular angular line 64, and align the bubble with that particular line.

Figure 3B:
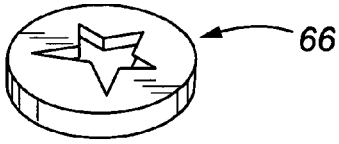
FIGS. 3B and 3C are perspective views of example ornaments that may be placed on the device in lieu of a bubble level.
Figure 3C:
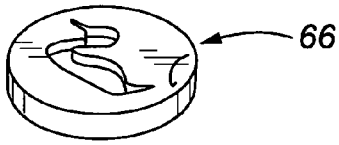
Figure 3D:
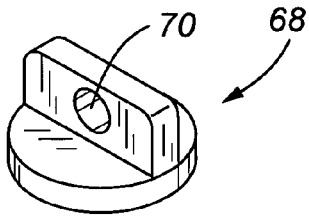
FIG. 3D is a perspective view of a key chain holder that may be placed on the device in lieu of a bubble level.

Referring to FIGS. 3B and 3C, in lieu of placing a bubble level on the device, an ornament 66 may be placed on the upper portion of the device thereby adding to the overall ornamentality of the device. The ornaments 66 shown are simply examples, and a user could choose any type of ornament in order to enhance the look of the device. As shown in FIG. 3D, yet another option is to attach a key chain holder 68 to the upper portion of the device, the holder 68 including a opening 70 for receiving a key chain or key ring (not shown).

Figure 4:
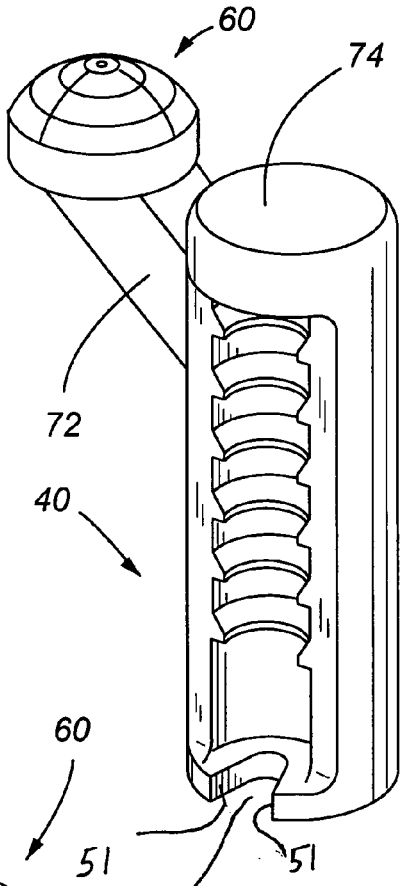
FIG. 4 illustrates a modification to the device wherein the bubble level is offset from the body of the device.

FIG. 4 illustrates a modification to the present invention wherein the device includes an arm 72 attached to the body, and placement of the bubble level 60 on the arm 72. Accordingly, the upper surface 74 of the body is free for the golfer to place the golfer's thumb or palm of the hand for setting the golf tee. Directing a force along the longitudinal axis of the device is made easier by pressing on the upper surface, and also avoids damaging and obscuring the bubble during use. Particularly, in dry ground conditions, it may be necessary to press on the upper surface of the device to improve the amount of force applied in penetrating the ground.

Figure 5:
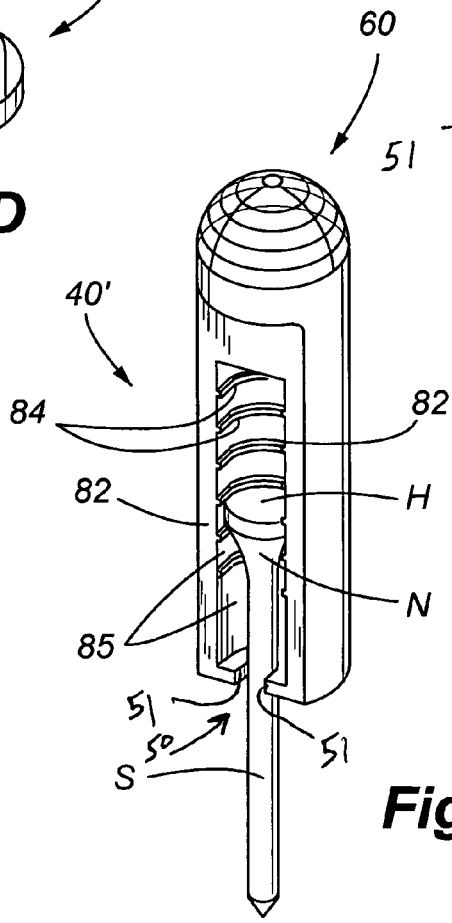
FIG. 5 is another perspective view of the second embodiment illustrating a modification to the feature used to create various tee settings.

FIG. 5 illustrates yet another embodiment shown as device 40' that is similar to the device 40; however, the particular shape of the features in the cavity have been changed. More specifically, a plurality of longitudinally spaced arcuate protrusions 84 are formed on the interior surface 85 defining the channel or cavity. The arcuate protrusions 84 are spaced from one another and sized so that the head H of the golf tee is secured between pairs of adjacent protrusions. Accordingly, various tee settings are provided between the protrusions. Also as desired, a setting/distance scale and/or a club head selection scale may be placed on faces 82 in the same manner as FIGS. 1 and/or FIG. 3A. As also shown in FIG. 5. the notch 50 has a substantially u-shaped configuration.

Figure 6:
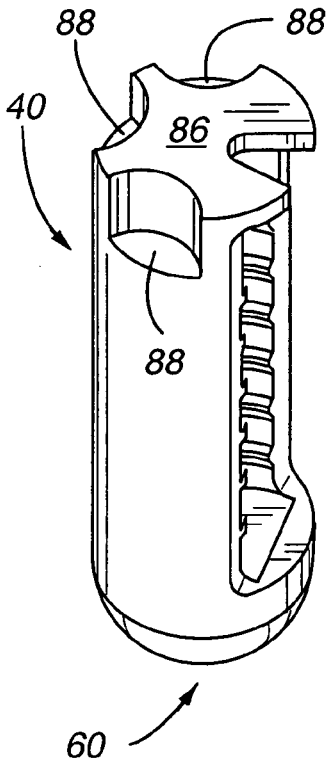
FIG. 6 is another perspective view of the present invention illustrating special features used to create low tee height settings.

Referring to FIG. 6, an additional feature that may be incorporated within the present invention includes the provision of a plurality of arcuate shaped recesses 88 formed on a bottom surface 86 of the device. Although this feature is shown as being combined with the third embodiment, it shall be also understood that the bottom portion of each of the embodiments may be so modified to include the arcuate recesses 88. When it is only desired to have the golf tee extend slightly above the level of the ground, a golfer simply inserts the head of the tee within the desired recess 88, and then presses the golf tee into the ground until the bottom surface 86 is flush with the ground. Particularly for teeing the ball on a par three hole, it may only be necessary or desired by the golfer to slightly raise the level of the golf ball above the ground. Accordingly, the recesses 88 are particularly adapted for use of the device in this circumstance.

Figure 7:
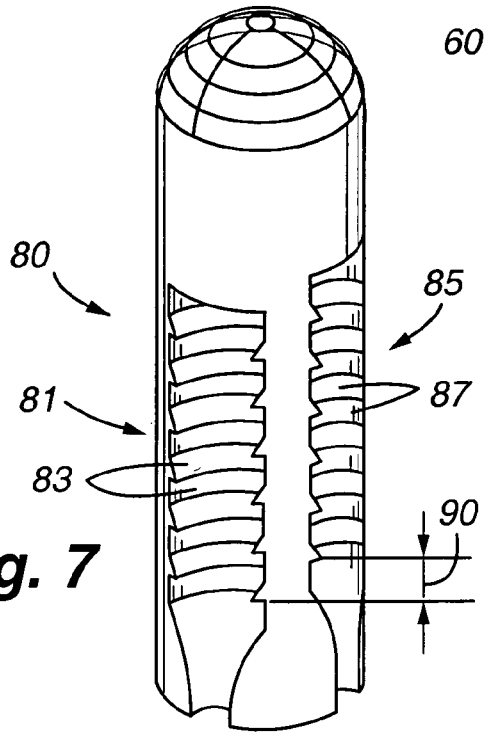
FIG. 7 illustrates yet another feature of the present invention in the form of an additional cavity formed in the body of the device thereby providing another set of tee height settings.

Referring to FIG. 7, yet another feature of the present invention is shown wherein a device 80 may include a first channel 81 with recesses 83 formed therein and adapted in size to create tee settings, and an additional channel 85 with recesses 87 formed therein to create additional tee settings. The recesses 83 and 87 may be longitudinally offset, the offset shown as differential distance 90. Thus, the offset arrangement between the channels provides the additional tee settings since the distance to the lower end of the device 80 is different for each recess.

Figure 8:
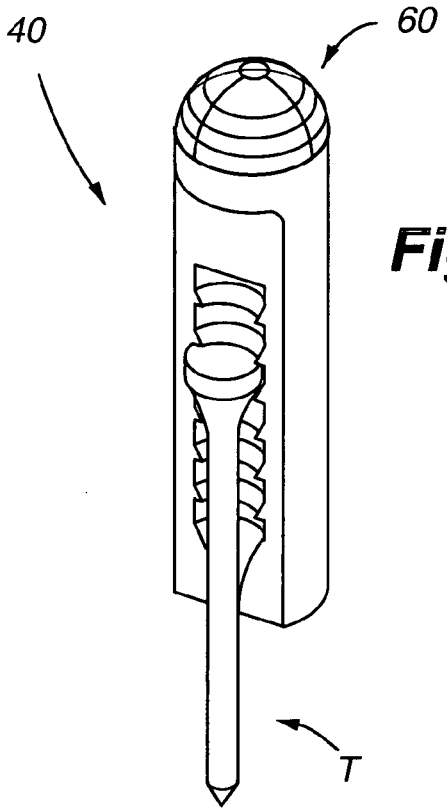
FIG. 8 is a perspective view illustrating the device having a cavity of a particular depth.
Figure 9:
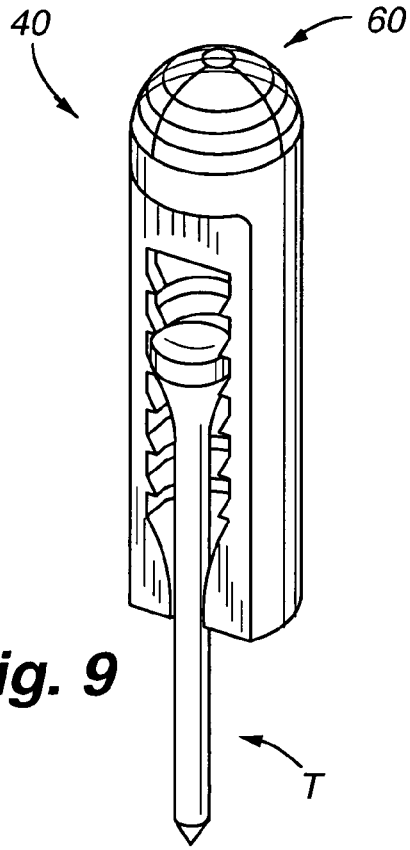
FIG. 9 is another perspective view similar to FIG. 8 but illustrating the device having a cavity of a different depth.

Referring to FIGS. 8 and 9, these figures simply illustrate the ability of the present invention to provide a cavity having variations in depth. Depending upon a golfer's preference, it may be desirable to provide a device with a deeper cavity depth thereby reducing effort required to maintain the tee within the cavity during insertion of the tee into the ground. Alternatively, it may be desirable to provide the cavity at a shallower depth, thereby easing disengagement of the tee from the device after the tee has been set. FIG. 8 shows a device with the shallower cavity while FIG. 9 shows a device with the deeper cavity.

Referring to FIG. 10, yet an additional feature contemplated within the present invention is to provide one or more protrusions in the form of set screws or shims 92 that protrude from the various recesses within the longitudinal cavity. The purpose of these protrusions is to adjust the angle at which the tee is set. The protrusions may be of differing lengths to thereby create different tee angles. For example, a golfer may wish to routinely place the golf tee at a particular forward or reverse angle with respect to the flight of the ball. Accordingly, use of one or more of the protrusions will result in the tee having an inherent angle or inclination with respect to the longitudinal axis of the device. Shim receiving holes 93 are provided along the cavity at desired locations to receive the shims. In use, a golfer secures a tee in the channel and maintains contact of the tee against the shims 92. The golfer can observe the bubble level which normally indicates vertical alignment of the tee, but because of the shims 92, the tee is inserted at the prescribed angle. A user may selectively remove or add shims 92 to adjust tee angles. As shown, the shims 92 may be either placed within the individual recesses, or may be placed within the portion of cavity below the most lower recess. Although FIG. 10 shows two shims 92, only one shim is required to provide some angularity. Additionally, the shims can be used to compensate for the size of the particular tee used to provide a desired tee angle. Not all tees have the same diameter at the head, and diameters also differ at the tee shafts. If a different type of tee is used with different dimensions, the golfer can then reset the shims to provide the necessary compensation for angularity.

Referring to FIG. 11, the rear or backside of the body is shown wherein a logo or advertisement 102 may be attached thereto.

As shown in FIG. 12, yet another feature contemplated within the present invention is an additional cavity or opening 104 formed in the body, and a plurality of brackets 106 sized and spaced from one another for securing golf tees.

Yet another feature of the present invention is shown in FIG. 13. An external arcuate groove 108 may be formed on the lower portion of the body, thereby providing a user a more ergonomic shape for grasping the device when setting the tee.

Although extension 72, recesses 88, shims 92, groove 108, and deeper vs. shallower cavity depths (FIGS. 8 and 9) have been illustrated with respect to a device having a particular type of channel/cavity, to include particular types of recesses for creating various tee settings, it shall be understood that these features can be used with any channel/cavity disclosed herein.

A number of different types of materials may be used for making the present invention. Perhaps the best material is a thermoplastic that can be molded into the desired shape. The shape of the present invention is easily repeatable within a molding process. The present invention could also be constructed of a metal which is either molded, or shaped as by use of a router and lathe. The present invention can also be made of wood. The bubble level may be made of a clear plastic such as acrylic.

While the foregoing invention has been described with respect to preferred embodiments, it shall be understood that various other changes and modifications to the invention can be made within the spirit and scope of the invention, as claimed.

What is claimed is:

1. A golf tee setting device comprising:

a body having a longitudinal cavity formed therethrough, and a slot formed in said body exposing said cavity, said body further including an upper end and a lower end;

a plurality of longitudinally spaced recesses defined by a corresponding plurality of ridges extending from said cavity, each said recess defining an area to receive a head of the golf tee thereby defining a particular setting for the golf tee;

an accessory attached to said upper end of said body, said accessory including a level; and an additional cavity formed in said body, and a plurality of brackets attached to said body within said additional cavity, said brackets extending from said additional cavity, and comprising a pair of spaced bracket members being especially adapted for holding one or more tees.

* * * * *